US007685908B1

(12) United States Patent
Sebastian et al.

(10) Patent No.: US 7,685,908 B1
(45) Date of Patent: Mar. 30, 2010

(54) DRINK INSULATOR WITH BOTTLE OPENER

(75) Inventors: Adam Sebastian, Winston-Salem, NC (US); Matthew Mayse, Winston-Salem, NC (US); Richard J. Regan, III, Winston-Salem, NC (US)

(73) Assignee: DesignFluence LLC, Clemmons, NC (US)

( * ) Notice: Subject to any disclaimer, the term of this patent is extended or adjusted under 35 U.S.C. 154(b) by 8 days.

(21) Appl. No.: 12/178,120

(22) Filed: Jul. 23, 2008

(51) Int. Cl.
*B67B 7/44* (2006.01)
*B67B 7/16* (2006.01)

(52) U.S. Cl. ..... 81/3.15; 81/3.09

(58) Field of Classification Search ..... 81/3.15, 81/3.09, 3.4, 3.55
See application file for complete search history.

(56) References Cited

U.S. PATENT DOCUMENTS

| | | | | |
|---|---|---|---|---|
| 2,731,182 | A | 1/1956 | Higgins | |
| 4,293,015 | A | 10/1981 | McGough | |
| 5,186,350 | A | 2/1993 | McBride | |
| 5,427,285 | A | 6/1995 | Kreitzman | |
| 5,551,592 | A | 9/1996 | Barton et al. | |
| D396,780 | S | 8/1998 | Villarreal, Jr. et al. | |
| D399,707 | S | 10/1998 | Villarreal, Jr. et al. | |
| 5,823,496 | A | 10/1998 | Foley et al. | |
| 6,318,573 | B1 | 11/2001 | Montero | |
| 6,382,411 | B1 | 5/2002 | Wentling | |
| 6,550,271 | B2 | 4/2003 | Silbert | |
| 6,942,131 | B2 | 9/2005 | Trautman et al. | |
| 6,976,370 | B2 | 12/2005 | Fiene | |
| 7,004,102 | B2 | 2/2006 | Sampson et al. | |
| 7,404,345 | B1 * | 7/2008 | Dipprey | 81/3.09 |
| 2002/0148868 | A1 | 10/2002 | Dion-Bildstein et al. | |
| 2002/0175169 | A1 | 11/2002 | Tham-itthisak | |
| 2003/0197104 | A1 | 10/2003 | Heybl et al. | |
| 2004/0232156 | A1 | 11/2004 | Hogan et al. | |
| 2005/0279751 | A1 | 12/2005 | Dempsey | |
| 2006/0016294 | A1 * | 1/2006 | McGrath et al. | 81/3.09 |
| 2007/0012140 | A1 * | 1/2007 | Howlett et al. | 81/3.09 |
| 2007/0074604 | A1 | 4/2007 | Lipson | |
| 2008/0060479 | A1 | 3/2008 | Nelson | |
| 2008/0072709 | A1 * | 3/2008 | Dye | 81/3.09 |

FOREIGN PATENT DOCUMENTS

| | | |
|---|---|---|
| JP | 2003-33264 | 2/2003 |

OTHER PUBLICATIONS

Can Cooler with Built-In Bottle Opener; epromos.com from the internet, related technology.

* cited by examiner

*Primary Examiner*—David B Thomas

(57) ABSTRACT

A combination device for insulating a beverage vessel and removing a bottle cap is disclosed. This device includes a generally cylindrically-shaped insulating sleeve, a substantially planar and disk-shaped metal insert with a rectangular aperture that pries off a bottle cap, and a ring-shaped structure that stabilizes the insert within the insulating sleeve.

14 Claims, 7 Drawing Sheets

DRINK INSULATOR WITH BOTTLE OPENER

BACKGROUND OF THE INVENTION (1) Field of the Invention

The present invention relates generally to devices for insulating beverage vessels and removing bottle caps and, more particularly, to a bottle opener which is inserted into a beverage vessel insulating sleeve such as a coozie.

(2) Description of the Prior Art

It is very common for companies to mass produce and distribute beverage insulators, commonly referred to as coozies or koozies, as a means to advertise their goods or service. Typically, a coozie is a cylindrically-shaped sleeve into which a standard twelve ounce can or bottle can snuggly fit, and is primarily composed of an insulated material such as foam, or a combination of foam and plastic. Coozies are useful because they keep drinks cool while in warm ambient temperatures.

Others have recognized the benefit of combining a beverage holding device with a bottle opening device. For example, US Patent Application Publication No. US 2007/0074604 to Lipson discloses a bottle opener which slips over the neck of a bottle. US Patent Application Publication No. US 2002/0175169 to Tham-itthisak discloses a drinking glass with a bottle opener integrated with the bottom. U.S. Pat. No. 6,318,573 to Montero discloses a bottle with an opener integrated into the bottom. US Patent Application Publication No. US 2008/0060479 to Nelson discloses a beverage holder that includes a bottle opener. However none of these references disclose a insulating beverage holder with a simple bottle opener that is inexpensive to manufacture and distribute, and easy to use. Thus there remains a need for a drink insulator with an add-on bottle opener.

SUMMARY OF THE INVENTION

The present invention is directed to a device for insulating a beverage vessel and removing a bottle cap. This device comprises a generally cylindrically-shaped insulating sleeve made of a thermal insulating material, and including a circumferential lip at one end of the cylinder, plus a substantially planar and disk-shaped metal insert that defines a rectangular aperture, plus a ring-shaped stabilizing structure with an inner circumference and an outer circumference. The rigid insert fits into the inner circumference of the stabilizing structure, and the outer circumference of the stabilizing structure fits into the circumferential lip of the insulating sleeve. This structure may include a plurality of support ribs connecting the inner circumference to the outer circumference.

Accordingly, one aspect of the present invention is to provide a device for removing a bottle cap, including a substantially disk-shaped insert, and a stabilizing structure, with the rigid insert engaged with the stabilizing structure.

Another aspect of the present invention is to provide the aforementioned bottle cap removing device with a coozie.

Yet another aspect of the present invention is to provide a promotional product which is relatively inexpensive and simple to manufacture and distribute, thereby facilitating name recognition and other marketing benefits.

Still another aspect of the present invention is to provide a device which allows a user to minimize the number of accoutrements necessary to enjoy a bottled beverage.

These and other aspects of the present invention will become apparent to those skilled in the art after a reading of the following description of the preferred embodiment when considered with the drawings.

DESCRIPTION OF THE PREFERRED EMBODIMENTS

Figure 1:
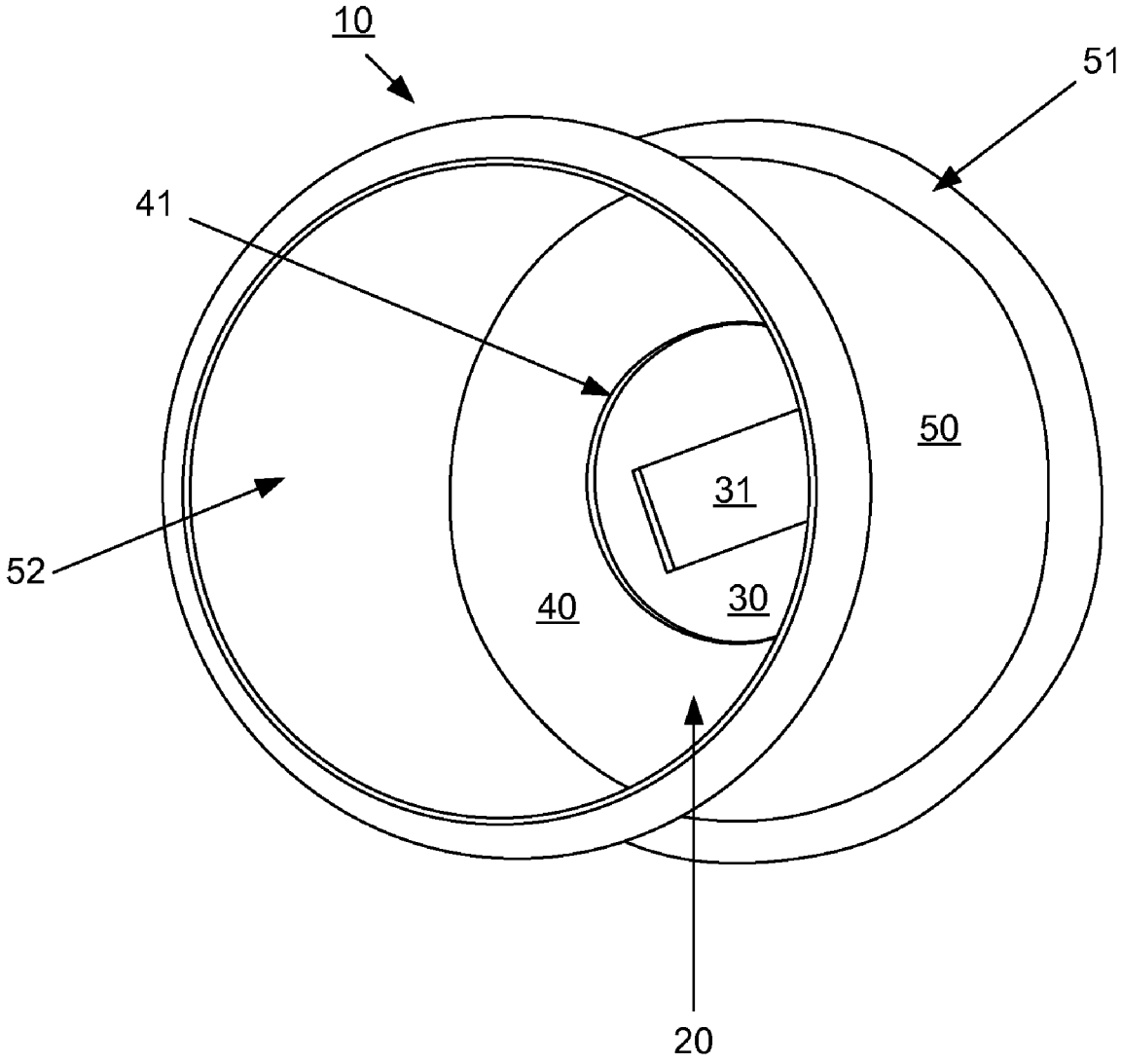
FIG. 1 is a perspective view of the coozie with installed bottle opener.

In the following description, like reference characters designate like or corresponding parts throughout the several views. Also in the following description, it is to be understood that such terms as "forward," "rearward," "left," "right," "upwardly," "downwardly," and the like are words of convenience and are not to be construed as limiting terms.

The following reference characters pertain to the following structural features:

10—insulating bottle opener
20—cap remover
30—insert
31—aperture
32—notch
40—stabilizing structure
41—inner circumference
42—outer circumference
44—first raised ridge
45—second raised ridge
47—support rib
50—insulating sleeve
51—circumferential lip
52—open end
55—beverage vessel
56—bottle cap Referring now to the drawings in general and FIG. 1 in particular, it will be understood that the illustrations are for the purpose of describing a preferred embodiment of the invention and are not intended to limit the invention thereto. As best seen in FIG. 1, insulating coozie with bottle opener 10 includes open end 52 at one end of the generally cylindrical insulating sleeve 50, and cap remover 20 at the other end. Having insulating sleeve 50 open at the bottom permits bottle cap 56 to be inserted into aperture 31, as seen best in FIG. 9. As used herein, "generally cylindrical" or "substantially cylindrical" refers to a structure which generally constitutes a cylinder, but may also include structural features such as lips, ridges, indentations, tabs and the like. Insulating sleeve 50 is conventional and may be made of an insulating material such as foam rubber, may include layers of various materials, and may include a component providing some rigidity. Cap remover 20 includes stabilizing structure 40 and insert 30. Insert 30 defines aperture 31 into which bottle cap 56 is inserted for opening, as better shown in FIG. 2. Insulating sleeve 50 and cap remover 20 can be engaged by snapping or wedging cap remover 20 into circumferential lip 51 resulting in a press fit, as well as by other engagements known in the art.

Figure 8:
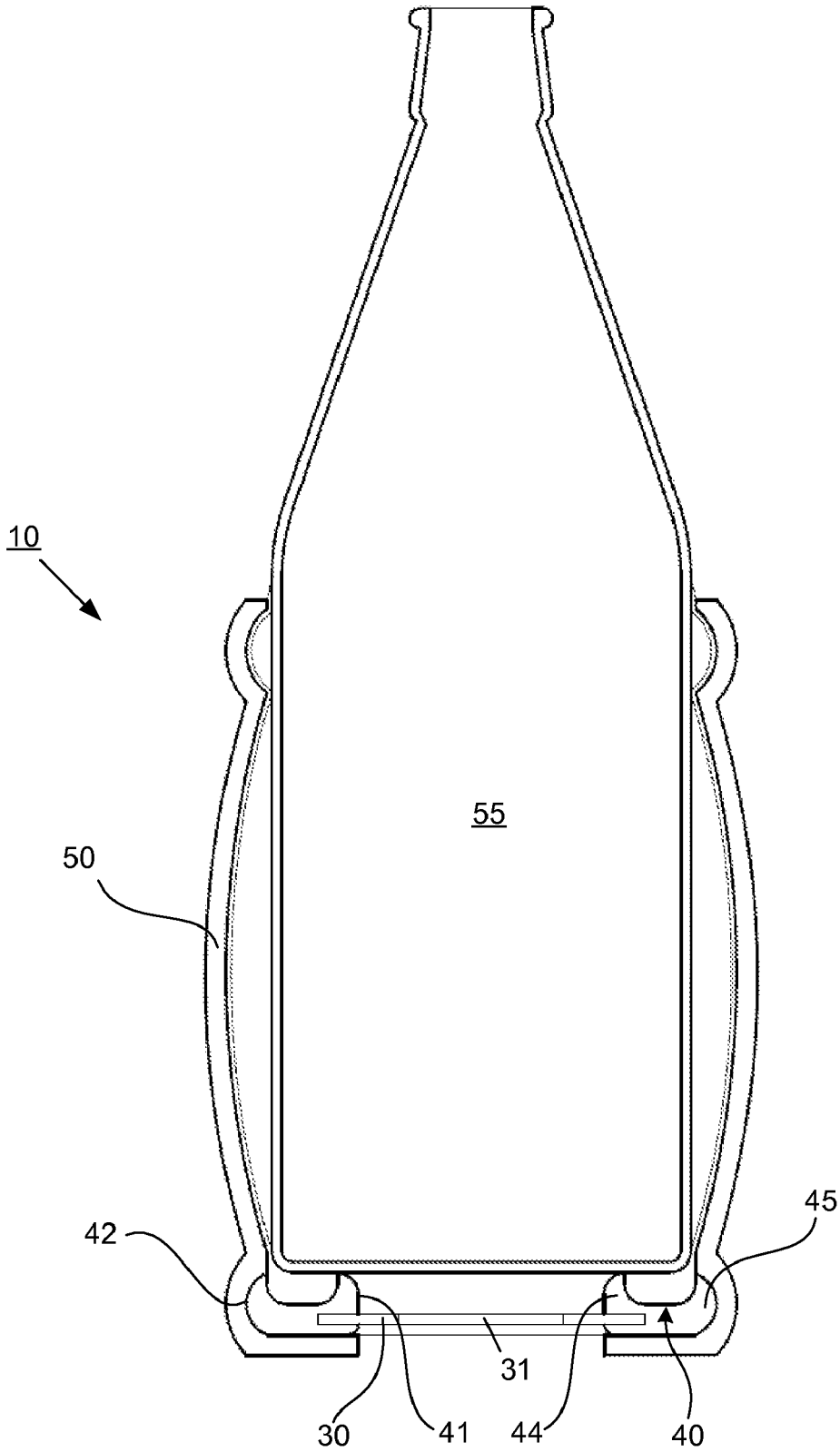
FIG. 8 is a side perspective view of the device.
Figure 9:
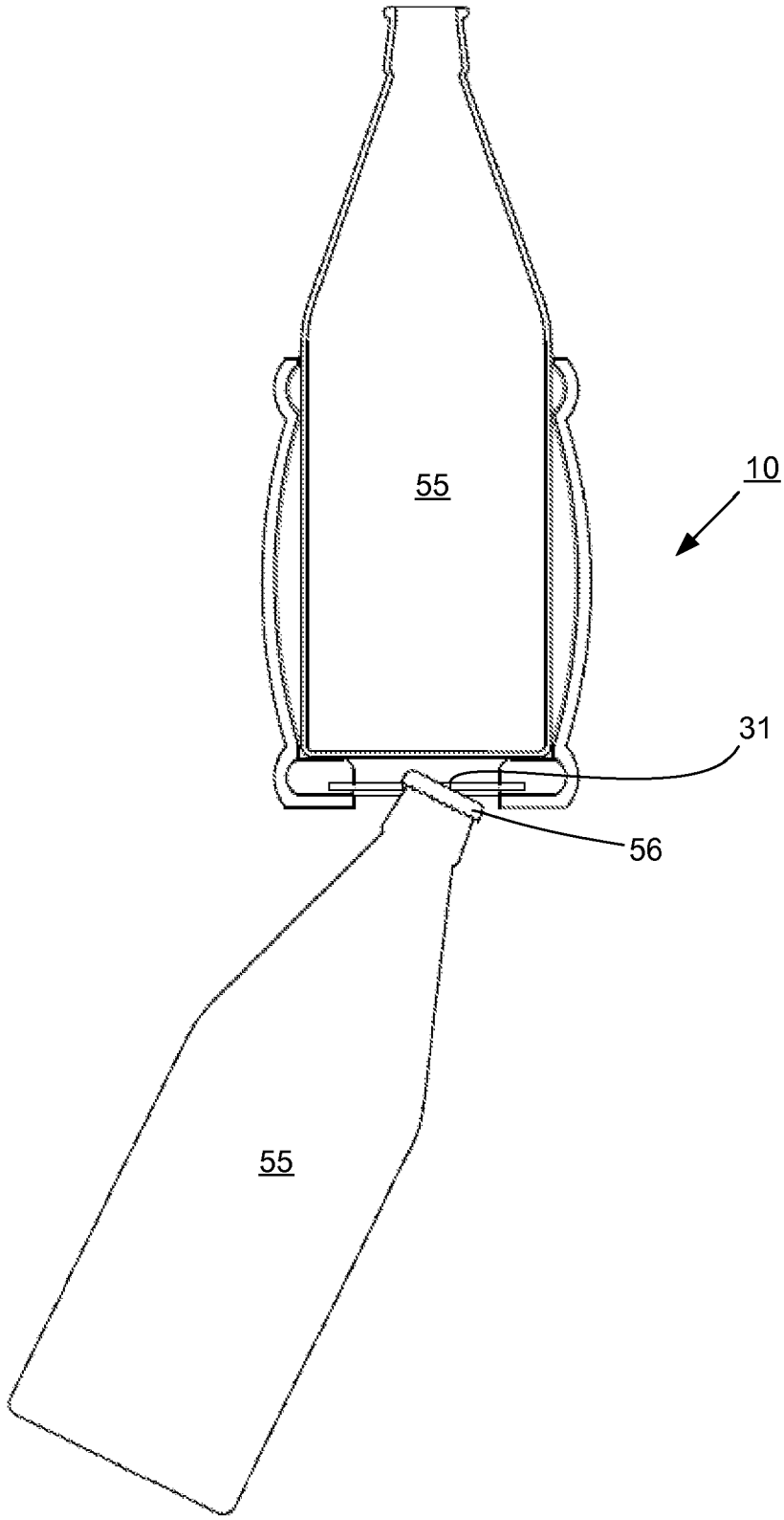
FIG. 9 is a side perspective view of the device in use.

Strength of engagement is enhanced when beverage vessel 55 is within insulating bottle opener 10, depicted in FIGS. 8 and 9.

Figure 2:
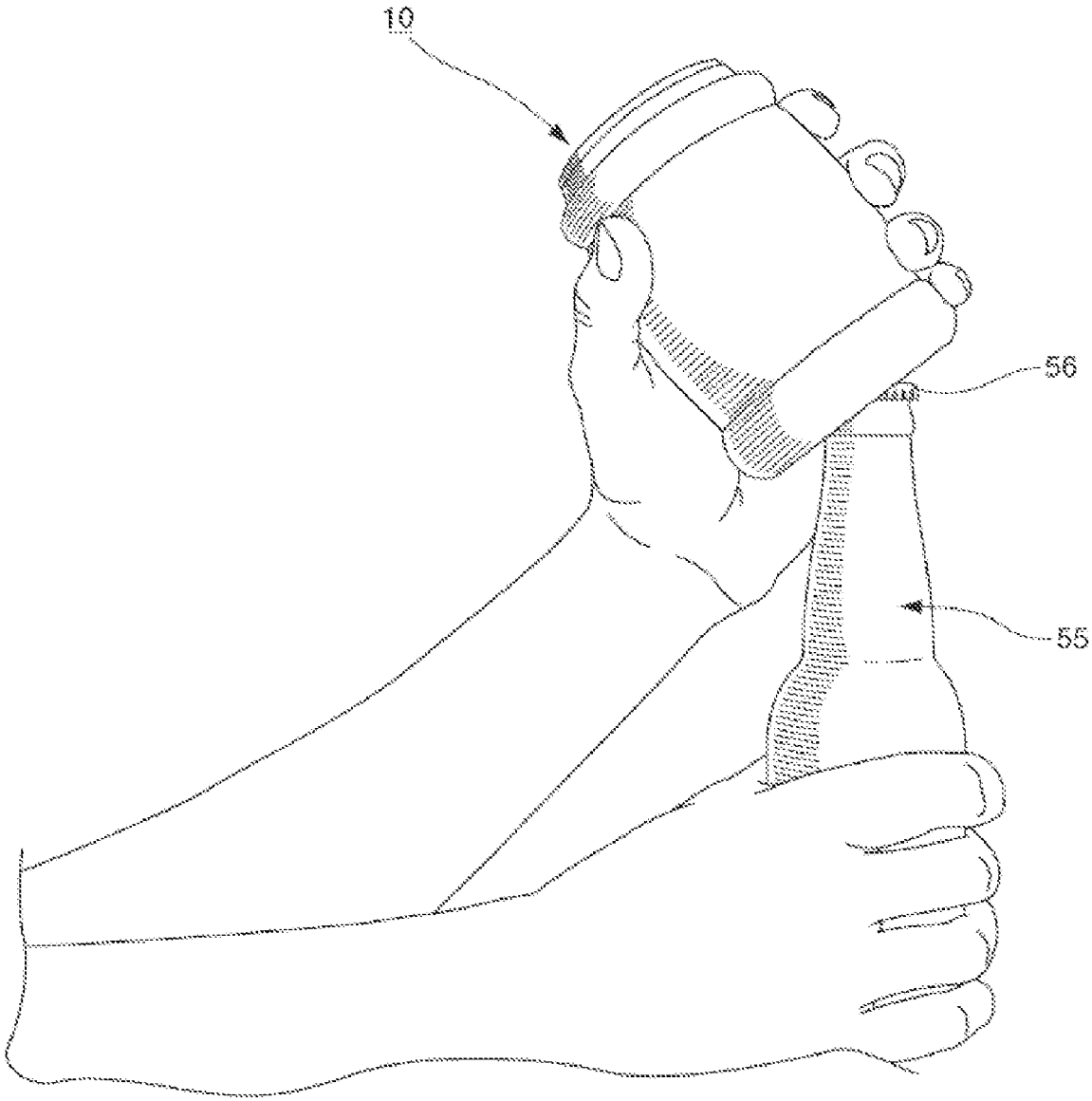
FIG. 2 illustrates the device in use.

Turning now to FIGS. 2 and 9, insulating bottle opener 10 is used to remove bottle cap 56 by wedging one side of bottle cap 56 in aperture 31. Aperture 31 is on the underside of insulating coozie 10. Insulating coozie 10 is then urged away from the wedged side of bottle cap 56, so the other side of the aperture bears on the bottle cap, thereby prying bottle cap 56 from beverage vessel 55.

Figure 3:
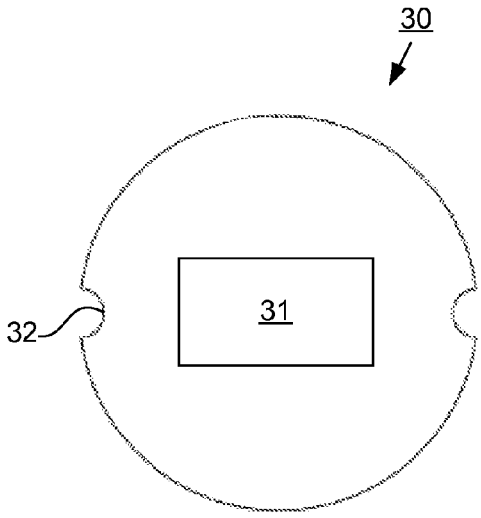
FIG. 3 is a top perspective view of the rigid insert.

As best shown in FIG. 3, insert 30 is a generally disk-shaped piece that defines aperture 31. Aperture 31 is preferably rectangular in shape but other suitable shapes can be used. Insert 30 preferably includes at least one notch 32. Notch 32 is useful to help engage the insert with surrounding material of the stabilizing structure, especially when the stabilizing structure is formed by injection molding around the insert. Insert 30 is preferably made of metal, but resilient alloys, plastics, composites, and the like would also be suitable so long as they can withstand the torsional forces, exerted thereon during the process of removing bottle cap 56. Preferably, insert 30 is formed by stamping processes which are known in the art as an inexpensive and reliable means to mass produce simple metal pieces. Used herein, "generally" or "substantially" disk-shaped refers to insert 30 generally being circular, flat and planar, but possibly including other features such as apertures, notches, tabs, ridges, indentations and the like.

Figure 4:
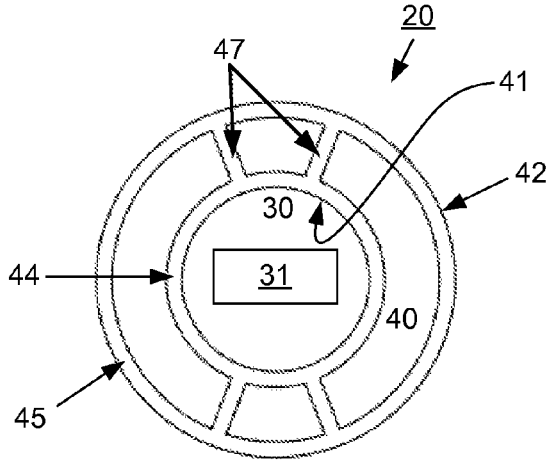
FIG. 4 is a top perspective view of the stabilizing structure and rigid insert.
Figure 6:
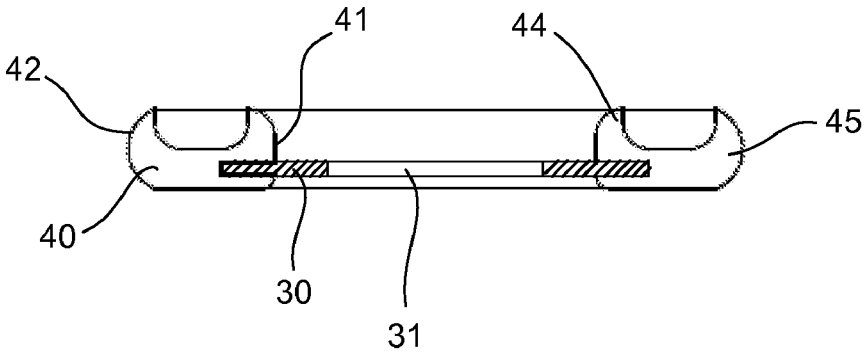
FIG. 6 is a side perspective view of the stabilizing structure and rigid insert as shown along lines 6, 6 of FIG. 5.
Figure 7:
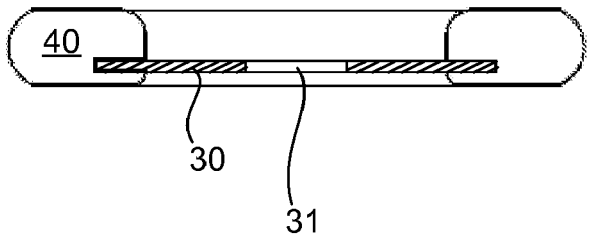
FIG. 7 is a side perspective view of the stabilizing structure and rigid insert shown along lines 7, 7 of FIG. 5.

FIG. 4 shows insert 30 within stabilizing structure 40, thereby collectively forming cap remover 20. Stabilizing structure 40 is preferably made of resilient plastic, but other materials such as metals, alloys, and composites may also be suitable. Stabilizing structure 40 is a generally ring-shaped member which defines inner circumference 41 and outer circumference 42. Preferably inner circumference 41 is bordered by first raised ridge 44, and outer circumference 42 is bordered by second raised ridge 45. This orientation is also depicted in FIGS. 6 and 7. Most preferably, at least one support rib 47 connects first raised ridge 44 to second raised ridge 45, which is to say support rib 47 connects inner circumference 41 to outer circumference 42. "Generally" and "substantially" ring-shaped, as used herein, refers to the general structure of ring (circular with hollow center) but possibly including features such as ridges, indentations, notches, protrusions, tabs and the like.

FIG. 8 generally shows position of beverage vessel 55 within insulating bottle opener 10, and orientation of insert 30 with respect to insulating sleeve 50 and beverage vessel 55.

The combination of insert 30 with stabilizing structure 40 to form cap remover 20 provides benefits such as ease of manufacturing, cost efficiency, ease in assembly, reproducibility, and strength, which would be expected in a much more expensive and complicated design. For example, first raised ridged 44 and second raised ridged 45 provide structural integrity to cap remover 20 in the most structurally vulnerable areas. Specifically, inner circumference 41 engages insert 30 and helps absorb the substantial torsional force that is exerted on insert 30. Further structural integrity for the inner circumference 41 is provided by first raised ridge 44. Similarly, outer circumference 42 rests in circumferential lip 51 of insulating sleeve 50, and benefits from additional structural integrity. This structural integrity is provided by second raised ridge 45. In this manner, raw materials are expended only where needed for purposes for providing strength to the structure, but are eliminated in areas where extra strength is not needed. This results in an inexpensively manufactured product that is amenable to mass production and distribution, in accordance with the general usefulness of coozies. Also, the voids between the ridges 44 and 45 and the ribs 47 provide an air gap to add to the insulating value of the coozie, preventing heat ingress through the bottom to the beverage vessel contained in the coozie. The stabilizing structure also lowers the center of gravity of the coozie, aiding in the cozies stability when a bottle is not within it.

In the most preferred embodiment, support rib 47 provides further structural integrity to cap remover 20. For example, it provides strength to prevent the collapse of first raised ridge 44 toward second raised ridge 45.

Figure 5:
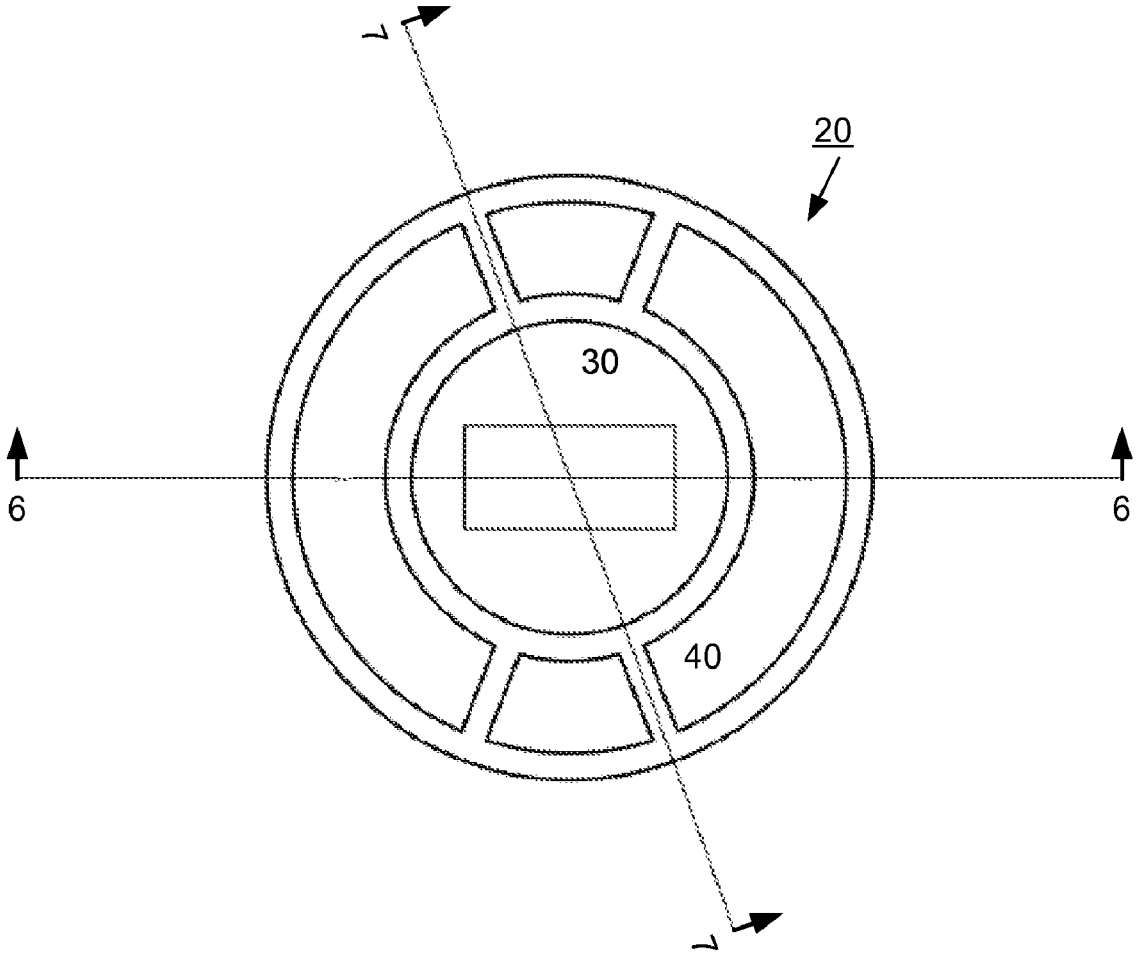
FIG. 5 is a top perspective view of the stabilizing structure and rigid insert showing cross sectional lines 6, 6 and 7, 7.

FIG. 5 shows cross sectional lines 6, 6 and 7, 7. Referring to FIGS. 6 and 7, the topography of the ridges is demonstrated. As seen, the area between first raised ridge 44 and second raised ridge 45 in FIG. 6 is rounded, but it would also be appropriate to have an alternatively shaped groove.

While insulating bottle opener 10 is particularly well suited for use with standard twelve ounce beverage bottles, it should be understood that the device is also useful for other types of vessels such as cans. Indeed, cap remover 20 is intentionally designed to be relatively flat and evenly weighted so as to be non-obtrusive for use with insulating sleeve 50. Accordingly, the resulting insulating bottle opener 10 can be used with all sorts of beverage vessels, and may be placed on a flat surface without fear of being easily knocked over.

In operation, one would insert standard sized beverage vessel 55 into open end 52 of insulating sleeve 50 and drink from beverage vessel 55 in the ordinary manner. When it is desired to remove bottle cap 56 from a second beverage vessel 55, one would place the cap remover 20 over bottle cap 56 and pry off bottle cap 56 in the manner described above. Used herein, "standard sized" pertains to beverage vessels generally known in the art, typically twelve ounce bottles or cans, that fit into standard coozies.

Certain modifications and improvements will occur to those skilled in the art upon a reading of the foregoing description. By way of example, aperture 31 could be of any size or shape that would be suitable for prying off a bottle cap, and is not limited to rectilinear shapes. Magnets could be incorporated into cap remover 20 so as to retain removed bottle cap 56 with cap remover 20, thus not allowing bottle cap 56 to fall onto the ground. Insert 30 and stabilizing structure 40 of cap remover 20 could be constructed of one rigid material, as opposed to being constructed from several materials. A twist-off apparatus could also be incorporated into insulating bottle opener 10 for twisting off "twist-off" bottle caps. Also, insert 30 does not have to be "disc like" in shape but could also be any other shape appropriate for the tool to work.

It should be understood that all such modifications and improvements have been deleted herein for the sake of conciseness and readability but are properly within the scope of the following claims.

We claim:

1. A device for removing a bottle cap, the device comprising:

a substantially rigid disk-shaped insert with a top surface, a bottom surface, and a perimeter and having an opening from the top surface to the bottom surface that is sized and configured to remove a cap from a bottle; and, a ring-shaped stabilizing structure comprising an inner circumference and an outer circumference that are strengthened by support ribs, the stabilizing structure surrounding and engaging the rigid disk-shaped insert top surface, bottom surface and perimeter with the inner circumference of the stabilizing structure, and the opening exposed and not covered by the stabilizing structure.

2. The device of claim 1, wherein the opening is rectangular.

3. The device of claim 1, wherein the rigid disk-shaped insert has at least one perimetral notch and the stabilizing structure is molded around and engages the notch.

4. The device of claim 1, wherein the stabilizing structure further comprises a first raised ridge circumscribing the inner circumference.

5. The device of claim 4, wherein the stabilizing structure further comprises a second raised ridge located at the outer circumference.

6. The device of claim 5, wherein the stabilizing structure further comprises at least one support rib connecting the first raised ridge to the second raised ridge strengthening the stabilizing structure when forces are applied during bottle cap removal.

7. A device for insulating a beverage vessel and removing a bottle cap, the device comprising:

a generally cylindrical insulating sleeve;

a substantially disk-shaped rigid insert including an opening; and, a ring-shaped stabilizing structure comprising an inner circumference and an outer circumference, wherein the rigid disk-shaped insert is engaged with the inner circumference of the stabilizing structure, and the outer circumference of the stabilizing structure is engaged with the insulating sleeve.

8. A device for insulating a beverage vessel and removing a bottle cap, the device comprising:

a generally cylindrically-shaped insulating sleeve comprised of thermally insulating material having an open top at one end and a circumferential lip at a bottom open end;

a substantially planar disk-shaped insert having an opening there through sized and configured to remove a cap from a bottle; and, a ring-shaped stabilizing structure including an inner circumference and an outer circumference, wherein the rigid disk-shaped insert is embedded within the stabilizing structure inner circumference, and the inside of the circumferential lip of the insulating sleeve is engaged with the outer circumference of the stabilizing structure.

9. The device of claim 8, wherein the insulating sleeve is sized to receive a standard sized beverage vessel.

10. The device of claim 8, wherein the stabilizing structure further comprises a plurality of support ribs connecting the inner circumference to the outer circumference allowing for the reduction of material while still allowing for structural stability and strength.

11. The device of claim 8, further including a standard sized beverage vessel, the beverage vessel abutting the stabilizing structure.

12. A method of removing a bottle cap from a beverage vessel comprising:

providing a beverage vessel insulating sleeve with a first open end and a second open end having a circumferential lip;

passing a disk through the first open end of the sleeve, the disk having an opening sized and configured for removing a cap from a bottle, the disk consisting of two distinct parts comprising 1) a substantially planar insert that includes the opening; and, 2) a ring-shaped stabilizing structure surrounding the circumference of the insert, the stabilizing structure further including an inner circumference and an outer circumference;

lodging the disk within the sleeve;

inserting a part of a bottle having a bottle cap into the opening of the disk-shaped insert; and, prying the cap off the bottle by leveraging the cap against an edge of the opening.

13. A method as claimed in claim 12, wherein the step of inserting a part of a bottle into the opening occurs with one beverage vessel while a second beverage vessel is nested within the sleeve.

14. A method as claimed in claim 12, wherein the step of lodging the disk within the sleeve includes press fitting the disk adjacent to the second open end that is opposite the first open end and engaging the circumferential lip of the sleeve.

* * * * *